US011338581B2

(12) United States Patent
Osuki et al.

(10) Patent No.: US 11,338,581 B2
(45) Date of Patent: May 24, 2022

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventors: Yohei Osuki, Nagareyama (JP); Sadayoshi Sakuma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/848,975

(22) Filed: Apr. 15, 2020

(65) Prior Publication Data

US 2020/0338887 A1 Oct. 29, 2020

(30) Foreign Application Priority Data

Apr. 23, 2019 (JP) ..... JP2019-082198

(51) Int. Cl.
*B41J 2/14* (2006.01)

(52) U.S. Cl.
CPC ..... *B41J 2/14129* (2013.01); *B41J 2/14072* (2013.01); *B41J 2202/11* (2013.01); *B41J 2202/13* (2013.01); *B41J 2202/18* (2013.01)

(58) Field of Classification Search
CPC ..... B41J 2/14129; B41J 2/14072; B41J 2202/13; B41J 2202/18; B41J 2202/11
See application file for complete search history.

(56) References Cited

U.S. PATENT DOCUMENTS

| | | | |
|---|---|---|---|
| 5,081,474 | A | 1/1992 | Shibata et al. |
| 7,722,148 | B2 | 5/2010 | Takabayashi et al. |
| 7,950,765 | B2 | 5/2011 | Takabayashi et al. |
| 8,172,355 | B2 | 5/2012 | Takabayashi et al. |
| 10,035,346 | B2 | 7/2018 | Kasai et al. |
| 10,493,774 | B2 | 12/2019 | Kanno et al. |
| 10,543,685 | B2 | 1/2020 | Naruse et al. |
| 2007/0229566 | A1 | 10/2007 | Takabayashi et al. |

(Continued)

FOREIGN PATENT DOCUMENTS

| | | | |
|---|---|---|---|
| CN | 105818537 | A | 8/2016 |
| CN | 109203695 | A | 1/2019 |

(Continued)

OTHER PUBLICATIONS

Co-Pending U.S. Appl. No. 16/848,983, filed Apr. 15, 2020.

(Continued)

*Primary Examiner* — Geoffrey S Mruk
(74) *Attorney, Agent, or Firm* — Venable LLP

(57) ABSTRACT

To suppress the progress of metal dissolution by ink when wire break of a wiring to a heater occurs, in an element substrate, according to the present invention, for example, which is used in an inkjet printhead, each of heaters integrated in the element substrate is connected to an individual wiring via a first through-hole penetrating an insulation layer, and further connected to a common wiring from the individual wiring via a wiring formed in another wiring layer via a second through-hole penetrating an insulation layer. The individual wiring and the common wiring are formed in the same wiring layer, and an aspect ratio of the second through-hole is lower than an aspect ratio of the first through-hole.

13 Claims, 14 Drawing Sheets

(56) References Cited

U.S. PATENT DOCUMENTS

| | | | | |
|---|---|---|---|---|
| 2010/0194810 | A1 | 8/2010 | Takabayashi et al. | |
| 2011/0164085 | A1 | 7/2011 | Takabayashi et al. | |
| 2016/0152027 | A1 | 6/2016 | Uyama et al. | |
| 2016/0297194 | A1 | 10/2016 | Sakurai et al. | |
| 2018/0370233 | A1 | 12/2018 | Kasai et al. | |
| 2019/0001678 | A1 | 1/2019 | Naruse et al. | |
| 2019/0001680 | A1* | 1/2019 | Miura | H05K 1/111 |
| 2019/0105921 | A1 | 4/2019 | Kanno et al. | |

FOREIGN PATENT DOCUMENTS

| | | | |
|---|---|---|---|
| CN | 109649012 | A | 4/2019 |
| JP | 2007-290361 | A | 11/2007 |
| JP | 2016-137705 | A | 8/2016 |

OTHER PUBLICATIONS

Extended EP Search Report dated Sep. 14, 2020, in counterpart EP20167223.5 (11 pages).
Office Action dated Jan. 24, 2022, in counterpart application CN 202010309623.2 (21 pages).

* cited by examiner

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, a printing apparatus using, as a printhead, a liquid discharge head incorporating an element substrate that suppresses dissolution by ink to perform printing in accordance with an inkjet method.

Description of the Related Art

There are known inkjet printheads (to be referred to as printheads hereinafter) that form ink droplets discharged by various methods. In particular, a printhead that uses a method of using heat from a heater for ink discharge can relatively easily implement multi-nozzles of high density, and can perform high-speed printing with a high resolution and high image quality.

It is known that when concurrently driving a plurality of heaters to perform printing, a voltage drop caused by wirings changes depending on the number of concurrently driven heaters, energy supplied to the heaters varies depending on the number of concurrently driven heaters, and discharge stability lowers. To solve this, a printhead described in Japanese Patent Laid-Open No. 2016-137705 uses a common wiring that makes a wiring layer connected to a heater thick and also makes the wiring layer wide as much as possible for the purpose of reducing the resistance of the wiring that causes a voltage drop.

In the printhead, an overcurrent may flow to the heater due to generation of an abnormal pulse such as noise, and an unexpected wire break may occur in the heater in the element substrate. Since the periphery of the heater in the element substrate is exposed to ink, the wiring connected to the heater is exposed to the ink at the time of a wire break. To drive remaining normal heaters, a voltage is supplied to the common wiring. As a result, electric erosion of the wiring occurs from the portion where the wire break has occurred in the heater. If this state continues, the electric erosion occurs even in the wirings of other heaters adjacent to the heater with the wire break, and the heaters may malfunction collectively from the heater with the wire break. In some printheads, recently, a technique of detecting a heater with a wire break and complementing printing by remaining normal heaters is introduced. However, if electric erosion of a wiring element spreads in the element substrate, complementary printing using remaining normal heaters is also difficult. As a result, image quality lowers.

SUMMARY OF THE INVENTION

Accordingly, the present invention is conceived as a response to the above-described disadvantages of the conventional art.

For example, an element substrate, a liquid discharge head, and a printing apparatus according to this invention are capable of suppressing spread of electric erosion of a wiring connected to a heater.

According to one aspect of the present invention, there is provided a multilayer structured element substrate including a heater layer in which a plurality of heaters are formed, and a first wiring layer in which a first common wiring configured to supply, from an outside, a voltage to the plurality of heaters is formed, comprising: an individual wiring formed in the first wiring layer and individually connected to each of the plurality of heaters; a first conductive plug provided between the heater layer and the first wiring layer and filling an interior of a first through-hole penetrating a first insulation layer that covers the first wiring layer; a second wiring layer formed in a layer under the first wiring layer; and a second conductive plug provided between the first wiring layer and the second wiring layer and filling an interior of a second through-hole penetrating a second insulation layer that covers the second wiring layer, wherein each of the plurality of heaters is connected to the individual wiring via the first conductive plug, and the individual wiring is connected to the first common wiring via the second conductive plug and a wiring of the second wiring layer, and an aspect ratio of the second through-hole is lower than an aspect ratio of the first through-hole.

According to another aspect of the present invention, there is provided a liquid discharge head using a multilayer structured element substrate including a heater layer in which a plurality of heaters are formed, and a first wiring layer in which a first common wiring configured to supply, from an outside, a voltage to the plurality of heaters is formed, comprising: a plurality of orifices configured to discharge a liquid, wherein the element substrate comprises: an individual wiring formed in the first wiring layer and individually connected to each of the plurality of heaters; a first conductive plug provided between the heater layer and the first wiring layer and filling an interior of a first through-hole penetrating a first insulation layer that covers the first wiring layer; a second wiring layer formed in a layer under the first wiring layer; and a second conductive plug provided between the first wiring layer and the second wiring layer and filling an interior of a second through-hole penetrating a second insulation layer that covers the second wiring layer, wherein each of the plurality of heaters is connected to the individual wiring via the first conductive plug, and the individual wiring is connected to the first common wiring via the second conductive plug and a wiring of the second wiring layer, and an aspect ratio of the second through-hole is lower than an aspect ratio of the first through-hole.

According to still another aspect of the present invention, there is provided a printing apparatus for performing printing on a print medium using a liquid discharge head configured to discharge a liquid as a printhead configured to discharge ink as the liquid, wherein the liquid discharge head comprises: a plurality of orifices configured to discharge the liquid; and a multilayer structured element substrate including a heater layer in which a plurality of heaters are formed, and a first wiring layer in which a first common wiring configured to supply, from an outside, a voltage to the plurality of heaters is formed, wherein the element substrate comprises: an individual wiring formed in the first wiring layer and individually connected to each of the plurality of heaters; a first conductive plug provided between the heater layer and the first wiring layer and filling an interior of a first through-hole penetrating a first insulation layer that covers the first wiring layer; a second wiring layer formed in a layer under the first wiring layer; and a second conductive plug provided between the first wiring layer and the second wiring layer and filling an interior of a second through-hole penetrating a second insulation layer that covers the second wiring layer, wherein each of the plurality of heaters is connected to the individual wiring via the first conductive plug, and the individual wiring is connected to the first common wiring via the second conductive plug and a wiring of the second wiring layer, and an aspect ratio of the second through-hole is lower than an aspect ratio of the first through-hole.

The invention is particularly advantageous since connection from a heater to a common wiring is made via the individual wiring of each heater. Hence, even if the individual wiring breaks, spread of electric erosion to the common wiring caused by the wire break is suppressed.

Further features of the present invention will become apparent from the following description of exemplary embodiments (with reference to the attached drawings).

DESCRIPTION OF THE EMBODIMENTS

Figure 1:
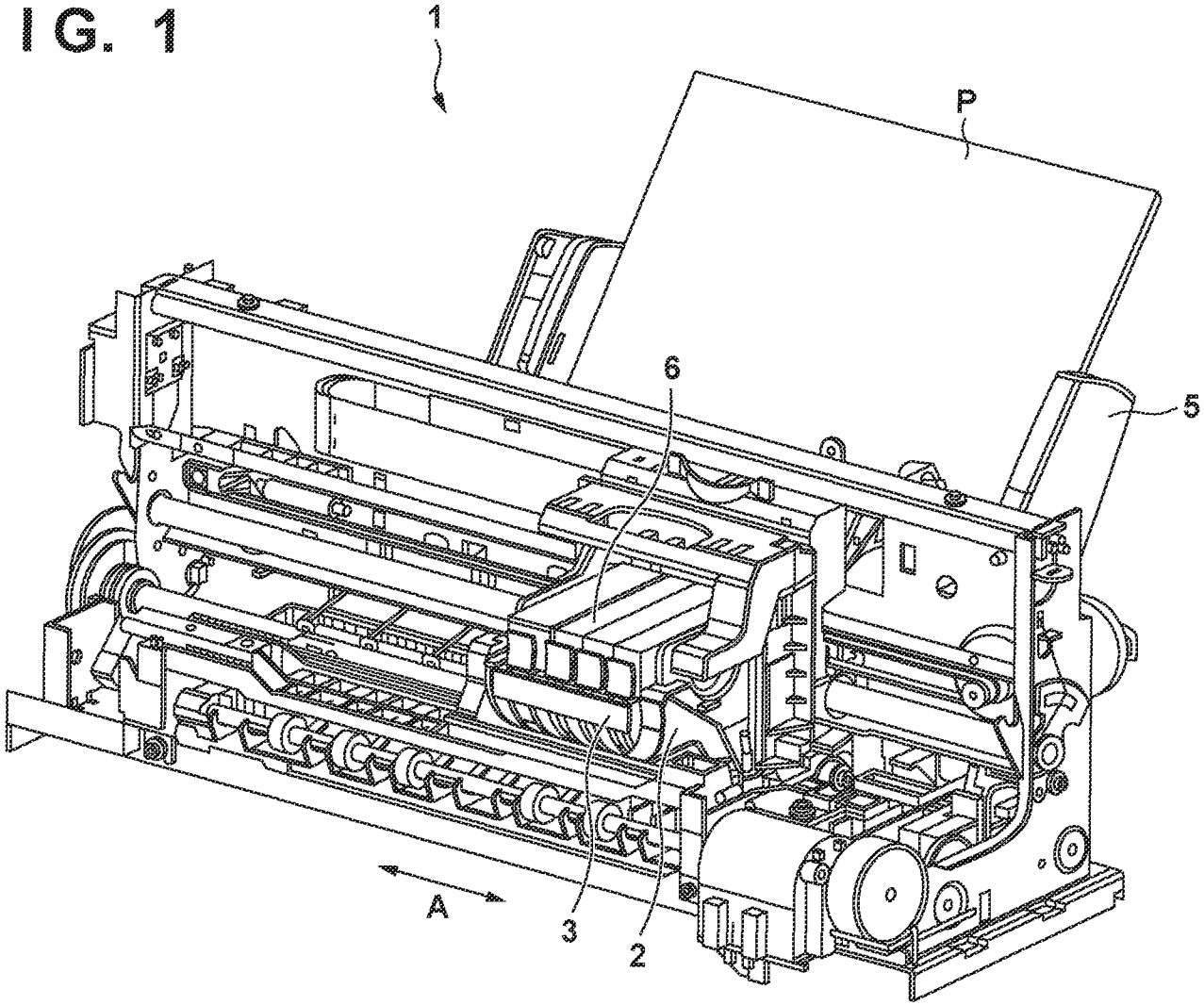
FIG. 1 is a perspective view showing the schematic arrangement of a printing apparatus including a printhead according to an exemplary embodiment of the present invention.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" (to be also referred to as "print element" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Outline of Printing Apparatus (FIGS. 1 and 2)>

FIG. 1 is an external perspective view showing the outline of the arrangement of a printing apparatus that performs printing using an inkjet printhead (to be referred to as a printhead hereinafter) according to an exemplary embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for this purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducer (heater). The electrothermal transducer is provided in correspondence with each orifice. A pulse voltage is applied to a corresponding electrothermal transducer in accordance with a print signal, thereby discharging ink from a corresponding orifice. Note that the printing apparatus is not limited to the above-described serial type printing apparatus, and the embodiment can also be applied to a so-called full line type printing apparatus in which a printhead (line head) with orifices arrayed in the widthwise direction of a print medium is arranged in the conveyance direction of the print medium.

Figure 2:
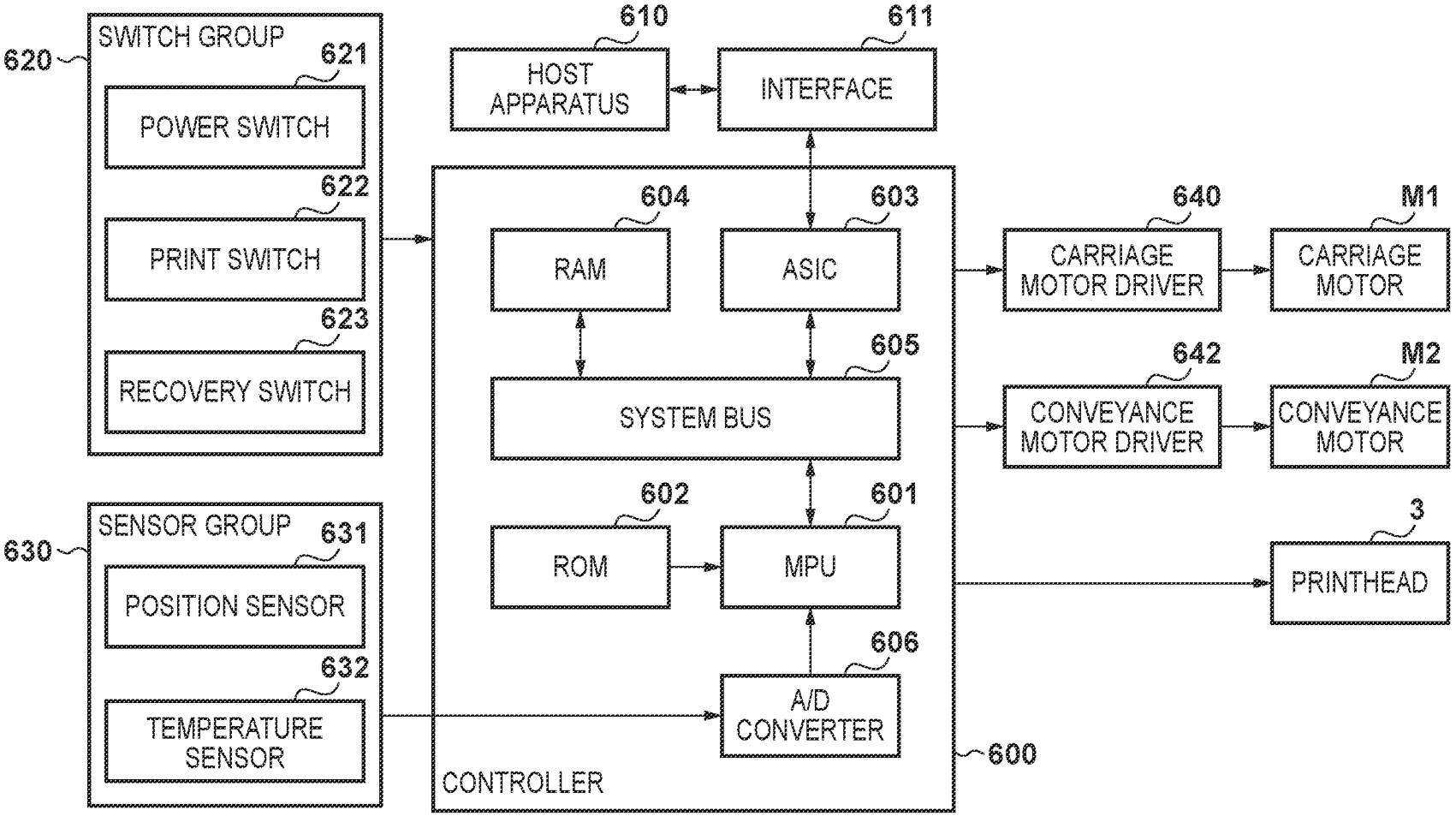
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed by an MPU 601, a ROM 602, an application specific integrated circuit (ASIC) 603, a RAM 604, a system bus 605, an A/D converter 606, and the like. Here, the ROM 602 stores programs corresponding to control sequences, necessary tables, and other fixed data. The ASIC 603 generates control signals for control of a carriage motor M1, control of a conveyance motor M2, and control of the printhead 3. The RAM 604 is used as an image data expansion area, a working area for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus, corresponding to a printing apparatus shown in FIG. 1 or an MFP, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host apparatus.

Reference numeral 620 denotes a switch group which is formed by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive a heating element (a heater for ink discharge) to the printhead while directly accessing the storage area of the RAM 604 at the time of print scan by the printhead 3. In addition, the printing apparatus includes a display unit formed by an LCD or an LED as a user interface.

Figure 3:
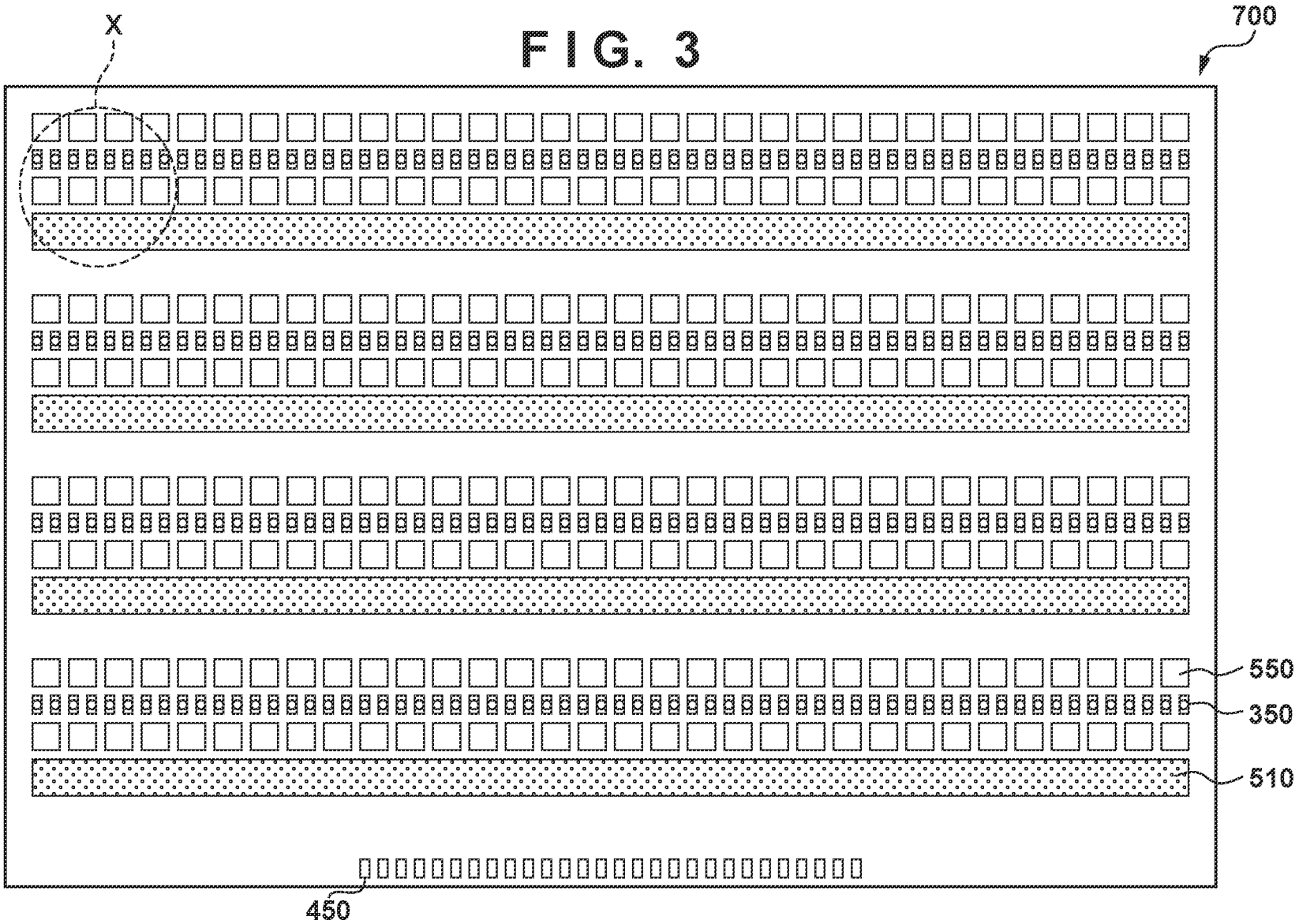
FIG. 3 is a view showing the layout arrangement of an element substrate (head substrate) integrated on a printhead.

FIG. 3 is a plan view showing the layout arrangement of an element substrate 700 integrated on the printhead 3.

The plane of the element substrate 700 shown in FIG. 3 has a rectangular shape. A plurality of pads 450 are provided along the long side of the rectangular plane of the element substrate 700, and data and a driving voltage are supplied from the outside (the main body portion of the printing apparatus) via the pads. A plurality of heaters 350, a plurality of ink supply ports 550, and a plurality of switching elements 510 are arrayed in the long side direction of the element substrate 700.

In the example shown in FIG. 3, four heater arrays, four ink supply port arrays, and four switching element arrays are provided. The four arrays are used to perform printing using magenta (M), cyan (C), yellow (Y), and black (K) inks, respectively.

Figure 4:
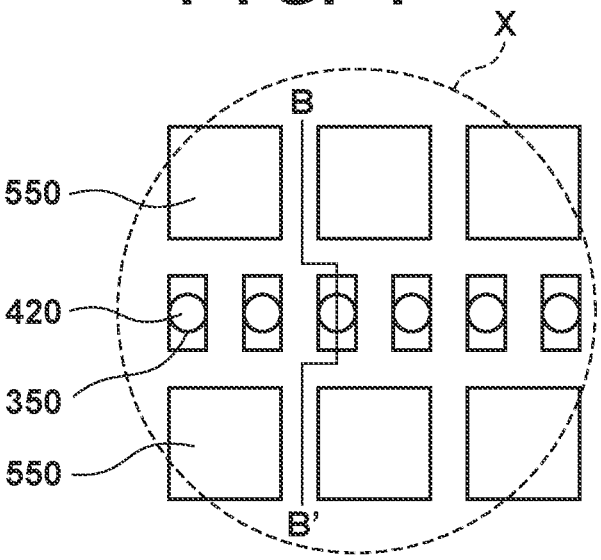
FIG. 4 is an enlarged view of a portion X of the element substrate shown in FIG. 3.

FIG. 4 is an enlarged view of a portion X shown in FIG. 3.

As shown in FIG. 4, an orifice 420 that discharges ink droplets is provided in correspondence with each heater 350 and the ink supply ports 550 that supply ink to the heaters are provided on both sides of the orifice array.

Figure 5:
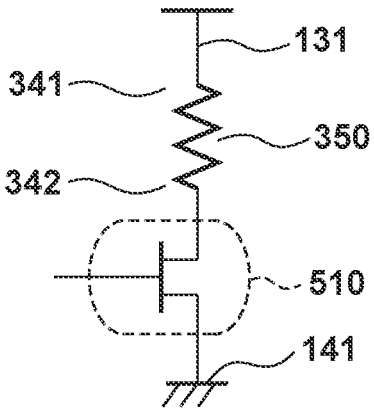
FIG. 5 is a view showing an equivalent circuit of a driving circuit configured to drive one heater.

FIG. 5 is a view showing an equivalent circuit of a driving circuit configured to drive one heater.

As shown in FIG. 5, a connecting portion 341 on one side of the heater (electrothermal transducer) 350 is electrically connected to a VH common wiring 131 used to supply a voltage. In addition, the other connecting portion 342 of the heater 350 is electrically connected to a GND common wiring 141 via the switching element 510 (driver) configured to switch ON/OFF the driving of the heater 350. In this example, the switching element 510 is a MOSFET. A driving voltage from the outside is applied to the gate of the MOSFET to switch ON/OFF and drive the heater 350.

Embodiments of the element substrate integrated on the printhead of the printing apparatus with the above-described arrangement will be described next.

First Embodiment

Here, an element substrate having a conventional arrangement will be described first as a comparative example, and then, the features of an element substrate according to this embodiment will be described.

Comparative Example and Problem

Figure 6:
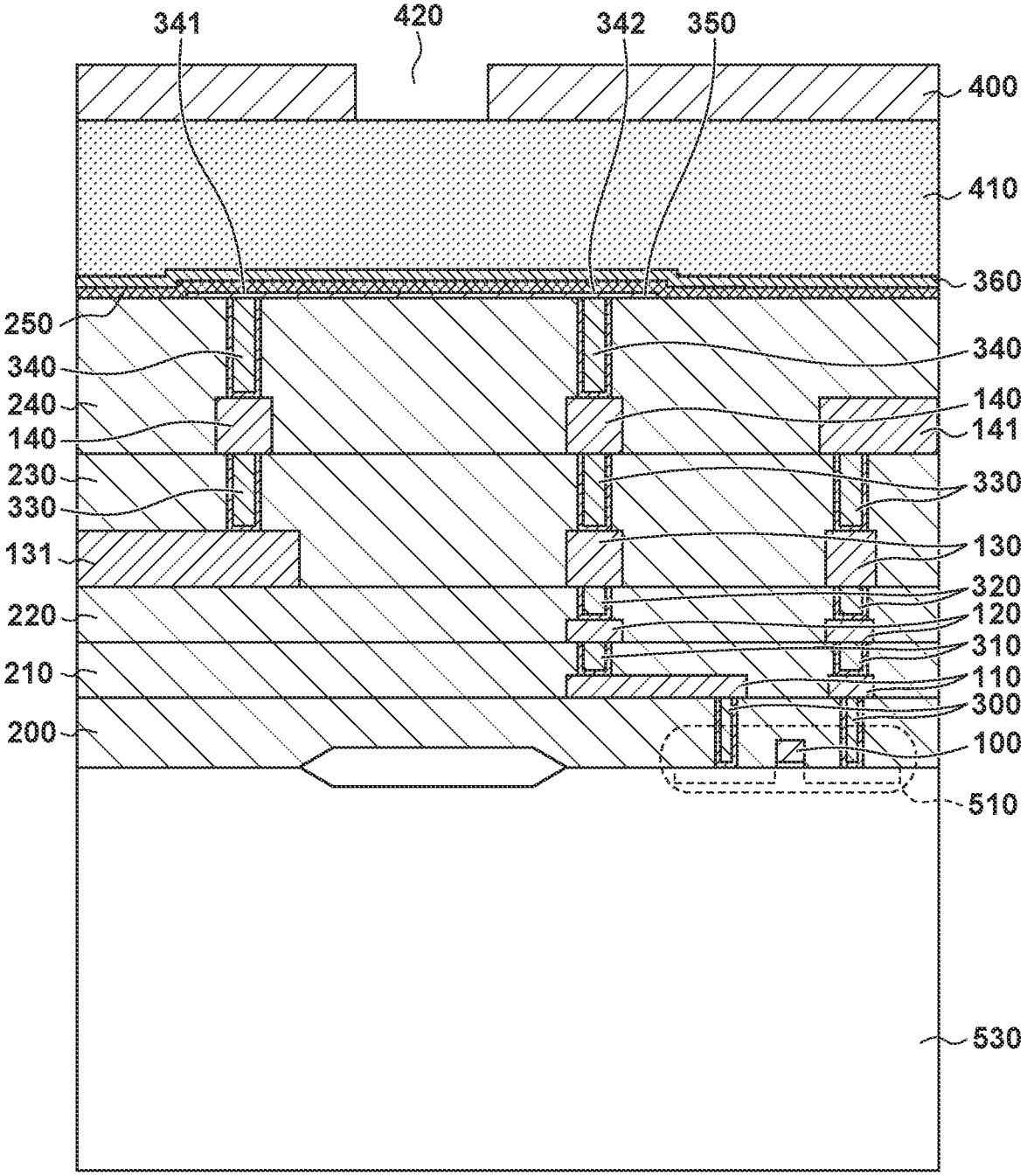
FIG. 6 is a sectional view showing the multilayer structure of an element substrate as a comparative example.

FIG. 6 is a sectional view showing the multilayer structure of an element substrate as a comparative example. This sectional view is a sectional view taken along a line B-B' shown in FIG. 4.

As shown in FIG. 6, a Poly-Si layer 100, wiring layers 110, 120, 130, and 140, the heater 350, and an anti-cavitation layer 360 are formed on an Si substrate 530, and the wiring layers are insulated by insulation layers 200, 210, 220, 230, 240, and 250. In addition, through-holes 300, 310, 320, 330, and 340 that penetrate the insulation layers to electrically connect the wirings are formed. The connecting portion 341 of the heater 350 is connected to the VH common wiring 131 formed by the wiring layer 130 via the through-hole 340, the wiring layer 140, and the through-hole 330. The VH common wiring 131 is electrically connected to a part of the pad 450 of the element substrate 700, and a voltage is supplied from the outside. On the other hand, the GND common wiring 141 is formed in the wiring layer 140 different from the VH common wiring 131.

Hence, to connect the VH common wiring 131 as shown in FIG. 5 to one terminal of the heater 350, connect the other terminal of the heater 350 to the switching element 510, and connect the switching element to the GND common wiring, elements of different layers are connected via the through-holes.

Note that in the element substrate 700, a plurality of heaters 350 are formed in the same layer, and the layer in which the plurality of heaters are formed is also called a heater layer. Additionally, a plurality of switching elements 510 are formed in the same layer different from the heater layer, and the layer in which the plurality of switching elements are formed is also called a switching layer.

The other connecting portion 342 of the heater 350 is connected to one terminal of the switching element via the through-hole 340, the wiring layer 140, the through-hole 330, the wiring layer 130, the through-hole 320, the wiring layer 120, the through-hole 310, the wiring layer 110, and the through-hole 300. The other terminal of the switching element is connected to the GND common wiring 141 formed by the wiring layer 140 via the through-hole 300, the wiring layer 110, the through-hole 310, the wiring layer 120, the through-hole 320, the wiring layer 130, and the through-hole 330.

An ink chamber 410 is provided on the heater 350. When the switching element 510 is turned on by data supplied from the outside, a current flows to the heater 350. As the heater generates heat, the ink foams and is discharged from the orifice 420 formed by a top plate 400 of the element substrate.

As is apparent from FIG. 6, the heater layer, the insulation layer 240, the wiring layer 140, the insulation layer 230, and the wiring layer 130, the insulation layer 220, the wiring layer 120, the insulation layer 210, the wiring layer 110, the insulation layer 200, and the switching layer are formed and arranged in this order from the upper layer to the lower layer of the element substrate.

Figure 7:
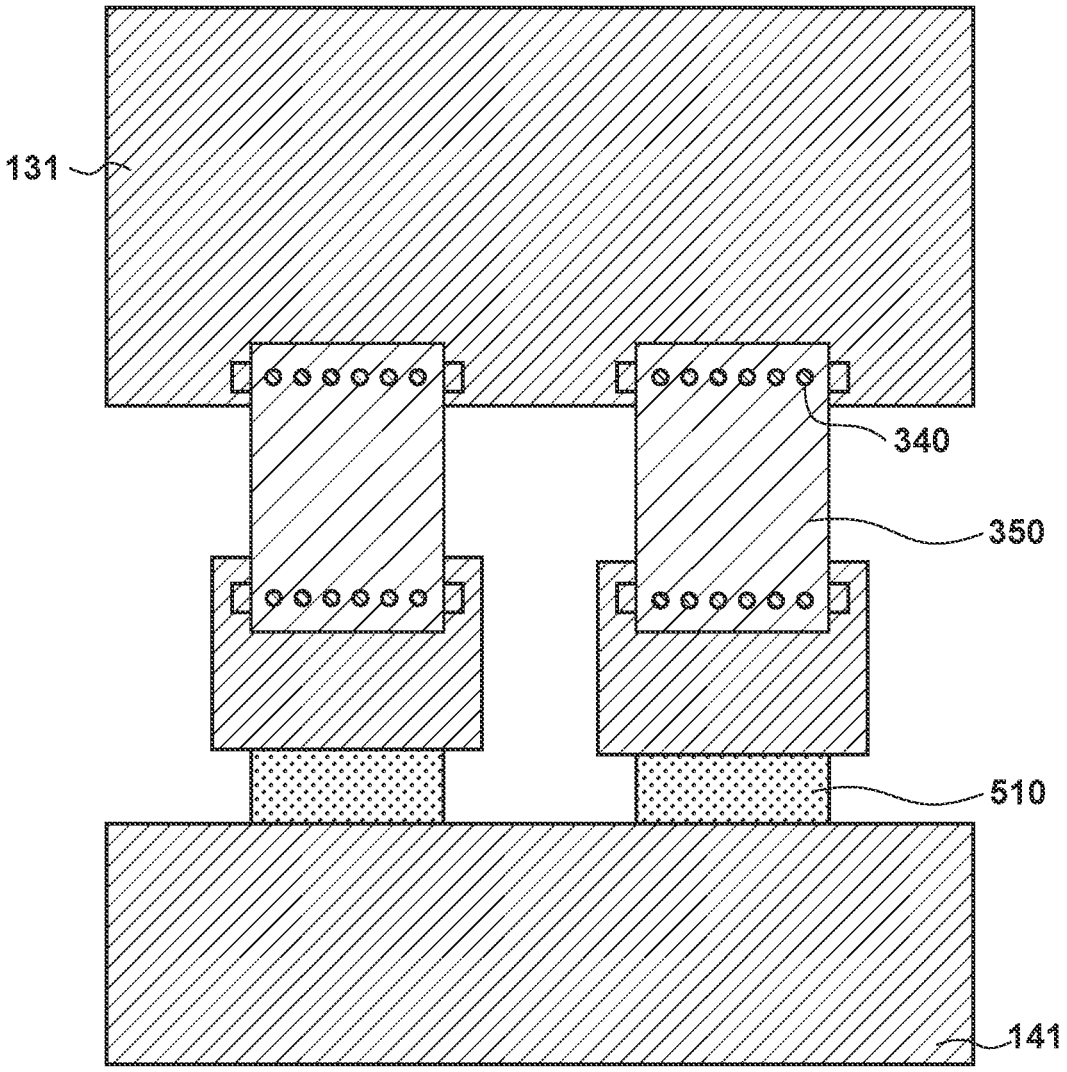
FIG. 7 is a plan view showing the state of the wirings of two heaters.

FIG. 7 is a plan view showing the state of the wirings of two heaters.

As shown in FIG. 7, the VH common wiring 131 is electrically connected to all of the plurality of heaters 350 via the through-holes and the wirings. In addition, a plurality of through-holes are arrayed in one line. The GND common wiring 141 is connected to all the switching elements 510 individually connected to the heaters 350. FIG. 7 shows the positions of the through-holes 340 that are in contact with the lower surfaces of the heaters 350.

Referring back to FIG. 6, the wiring layers 110, 120, 130, and 140 are made of aluminum or an alloy (for example, AlSi or AlCu) containing aluminum. The wiring layers 110 and 120 are wiring layers that form signal wirings mainly used for data transfer. Since the current that flows is small, and the wiring layers are rarely affected by the wire resistance, the film thickness is relatively as small as about 200 nm to 500 nm. On the other hand, the wiring layer 130 is a wiring layer that forms the VH common wiring 131, and the wiring layer 140 is a wiring layer that forms the GND common wiring 141. Hence, the wiring layers 130 and 140 are used to supply a current to the heater. Since the current that flows is large, and the wiring layers are readily affected by the wire resistance, the film thickness is relatively as large as 600 nm or more. The insulation layers 210 and 220 that cover the wiring layers 110 and 120 of the relatively small film thickness are formed to a relatively small film thickness, and the insulation layers 230 and 240 that cover the wiring layers 130 and 140 of the relatively large film thickness are formed to a relatively large film thickness.

Figure 8A:
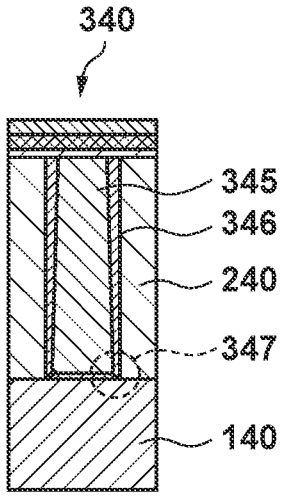
FIGS. 8A, 8B, and 8C are sectional views showing the structures of three through-holes.
Figure 8B:
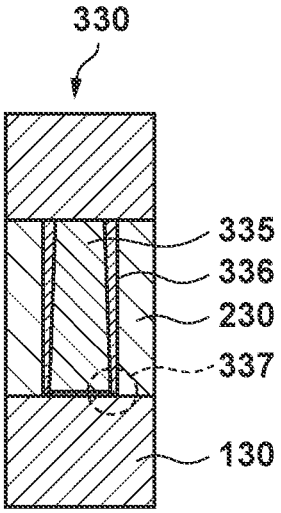
Figure 8C:
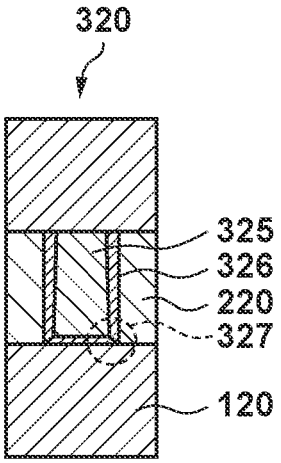

FIGS. 8A to 8C are sectional views showing the detailed structures of three through-holes.

The three through-holes shown in FIGS. 8A to 8C show the detailed structures of the three through-holes 340, 330, and 320 shown in FIG. 6. FIG. 8A shows the structure of the through-hole 340, FIG. 8B shows the structure of the through-hole 330, and FIG. 8C shows the structure of the through-hole 320.

The through-hole 330 shown in FIG. 8B is formed and arranged in a columnar shape while penetrating the insulation layer 230 on the wiring layer 130 formed to a thickness of, for example, 1,000 nm. The through-hole 330 is formed to, for example, a diameter of 0.6 μm and a height of 1.4 μm. The aspect ratio at this time is 1.4/0.6=2.333. A barrier metal layer 336 exists around a conductive plug (to be referred to as a plug hereinafter) 335 that fills the interior of the through-hole 330. That is, the barrier metal layer 336 is formed on the lower surface portion and the side surface portion of the space in the through-hole 330, and a portion of the space in the through-hole 330, where the barrier metal layer 336 is not provided, is filled with the plug 335. Hence, a first barrier metal layer is formed around the plug 335 on the lower surface side and the side surface side. The plug 335 is generally made of tungsten, and the barrier metal layer 336 is made of, for example, titanium Ti or a material (for example, TiN) containing Ti. Reference numeral 337 denotes a corner portion of the plug 335.

In the element substrate 700, an overcurrent may flow to the heater 350 due to generation of an abnormal pulse such as noise, and an unexpected wire break may occur in the heater in the element substrate.

Figure 9:
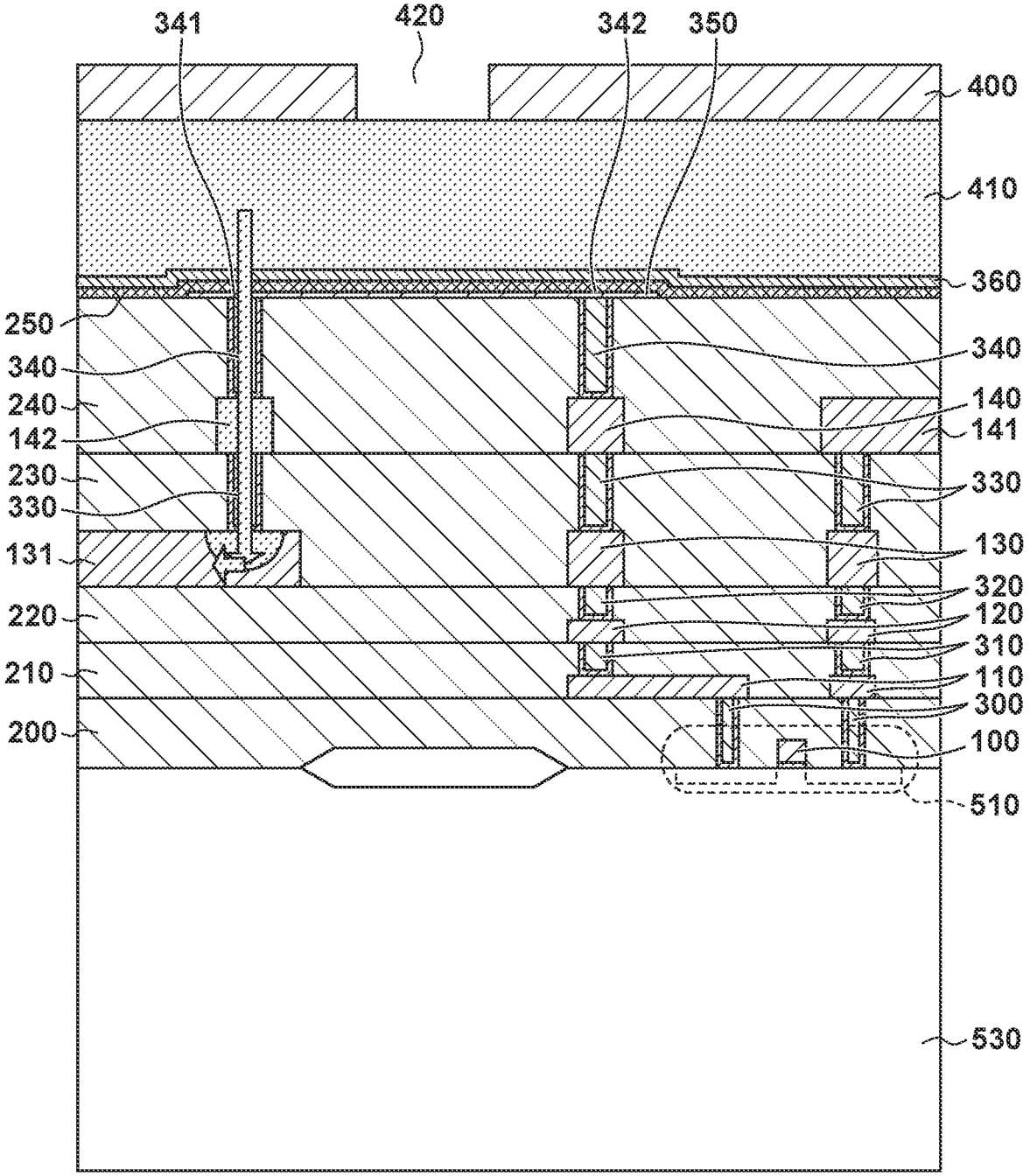
FIG. 9 is a sectional view of an element substrate having a multilayer structure so as to schematically show a state in which a wire break has occurred in a heater.

FIG. 9 is a sectional view of an element substrate having a multilayer structure so as to schematically show a state in which a wire break has occurred in the heater. FIG. 9 is a sectional view of an element substrate having the same multilayer structure as that shown in FIG. 6. Hence, reference numerals shown in FIG. 9 are the same as in FIG. 6, and a description thereof will be omitted.

When a wire break occurs, the ink-tolerant anti-cavitation layer 360 is partially lost in the heater, the plug made of tungsten is exposed to the ink. In tungsten, metal dissolution by the ink progresses even if an electric potential is not applied. In addition, since the connecting portion 341 is connected to a high potential (VH) in fact, the dissolution of tungsten may further progress.

FIG. 8A shows the through-hole 340. After the through-hole is formed in the insulation layer, a barrier metal layer 346 is formed on the bottom surface portion and the side surface portion of the through-hole before the interior of the through-hole is filled with the plug 345. Here, since the barrier metal layer hardly dissolves in ink as compared to tungsten, the progress of dissolution is originally suppressed by the barrier metal layer. However, when the aspect ratio of the through-hole becomes high, the film-forming material that forms the barrier metal layer can hardly reach a corner portion 347 of the through-hole. For this reason, the film thickness of the barrier metal layer readily becomes small at the corner portion 347, and in some cases, the film thickness of the barrier metal layer is not sufficient, and dissolution by ink progresses.

Figure 10:
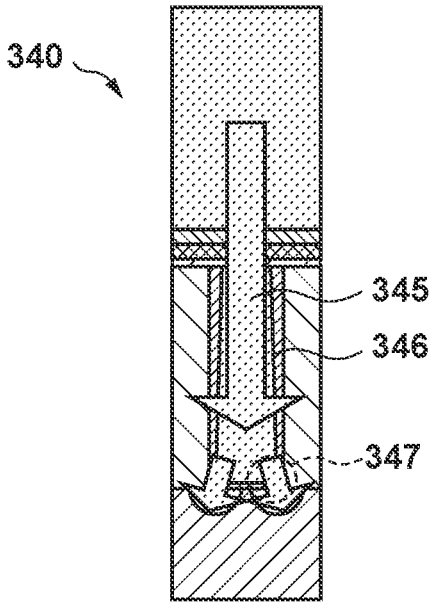
FIG. 10 is a view schematically showing the state of a through-hole 340 in which dissolution has progressed.

FIG. 10 is a view schematically showing the state of the through-hole 340 in which dissolution has progressed.

As shown in FIG. 10, dissolution progresses from the corner portion 347 of a conductive plug (to be referred to as a plug hereinafter) 345 that fills the interior of the through-hole 340 through a barrier metal layer 346.

The ink that has broken through the barrier metal layer dissolves an aluminum wiring (wiring 142) in the wiring layer 140, and dissolution similarly progresses in the through-hole 330 as well.

Figure 11:
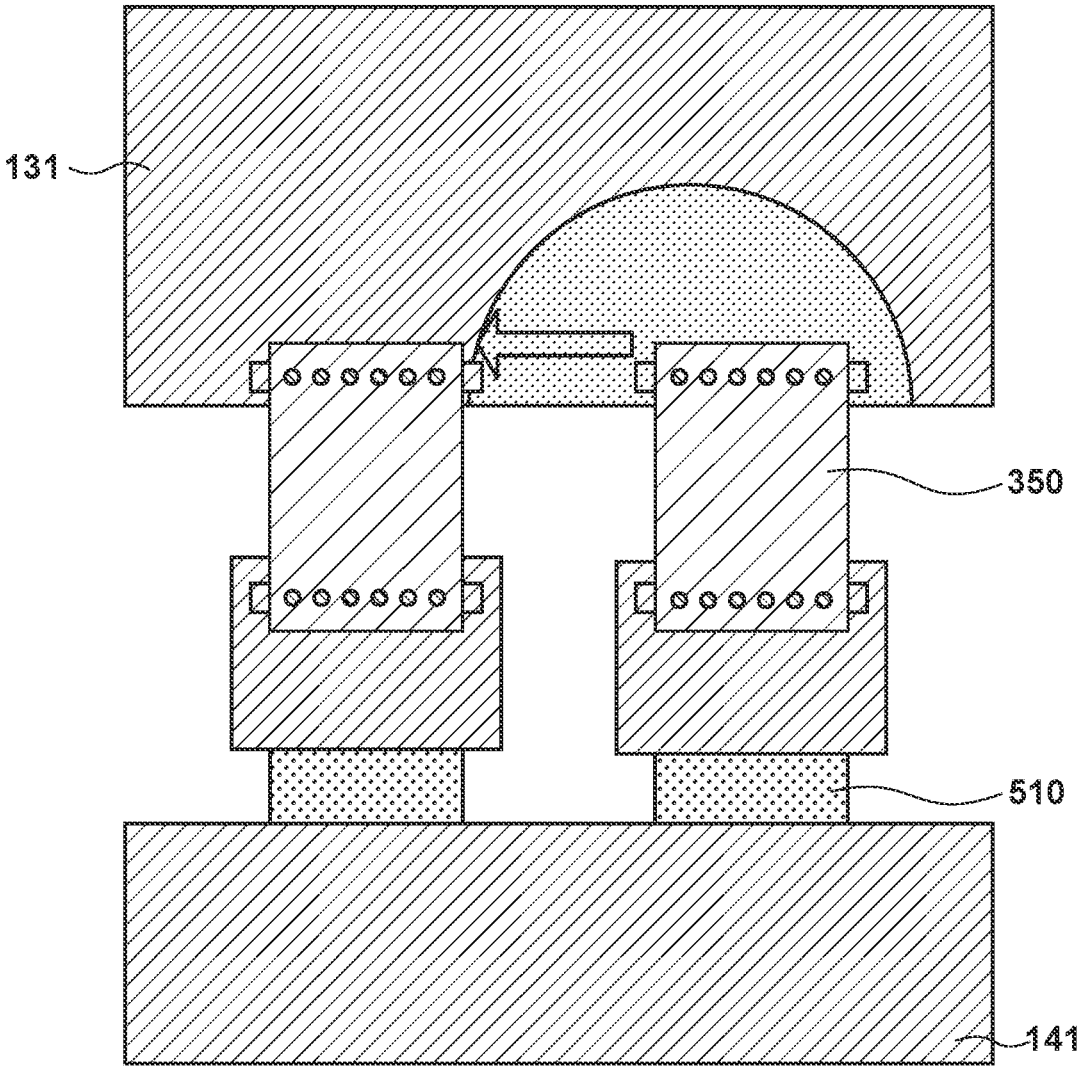
FIG. 11 is a plan view schematically showing the state of a VH common wiring in which dissolution has progressed.

FIG. 11 is a view schematically showing the state of the VH common wiring in which dissolution has progressed.

As shown in FIG. 11, when dissolution progresses, the dissolution of the VH common wiring 131 made of Al may reach the wiring portion of an adjacent heater.

As a result, the adjacent heater also malfunctions due to the wire break in one heater. The dissolution of the VH common wiring of Al may further progress, and the heaters may collectively malfunction.

<Structure of Element Substrate According to First Embodiment>

Figure 12:
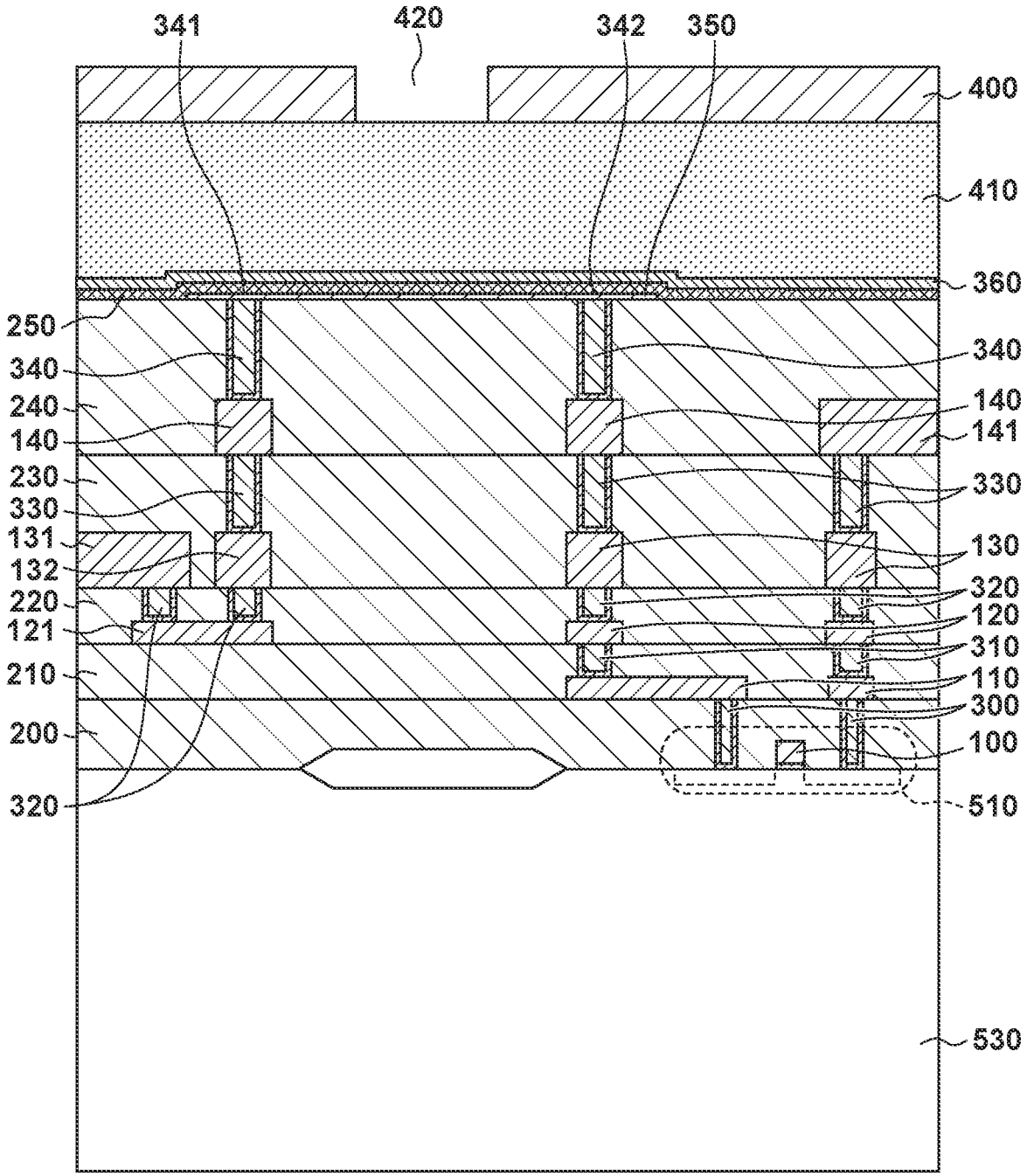
FIG. 12 is a sectional view showing the multilayer structure of an element substrate according to the first embodiment.

FIG. 12 is a sectional view showing the multilayer structure of an element substrate according to the first embodiment. Note that the same reference numerals as already described with reference to FIGS. 6 and 9 denote the same constituent elements in FIG. 12, and a description thereof will be omitted. A characteristic arrangement of the first embodiment and its effect will be described here. Like FIG. 6, this sectional view is a sectional view taken along a line B-B' shown in FIG. 4.

As shown in FIG. 12, the connecting portion 341 of the heater 350 is connected to the through-hole 340, the wiring layer 140, the through-hole 330, a wiring 132 formed in the wiring layer 130, the through-hole 320, and a wiring 121 formed in the wiring layer 120. The connecting portion 341 is further connected from the wiring 121 to the VH common wiring 131 formed in the wiring layer 130 via the through-hole 320. Here, the wiring 132 is individually separately provided for each heater (in correspondence with each heater), unlike the VH common wiring 131. Hence, the wiring 132 is also called an individual wiring. In this embodiment, the individual wiring (wiring 132) is formed by the wiring layer 130 that forms the VH common wiring 131, and formed in the same layer as the VH common wiring 131.

Figure 13:
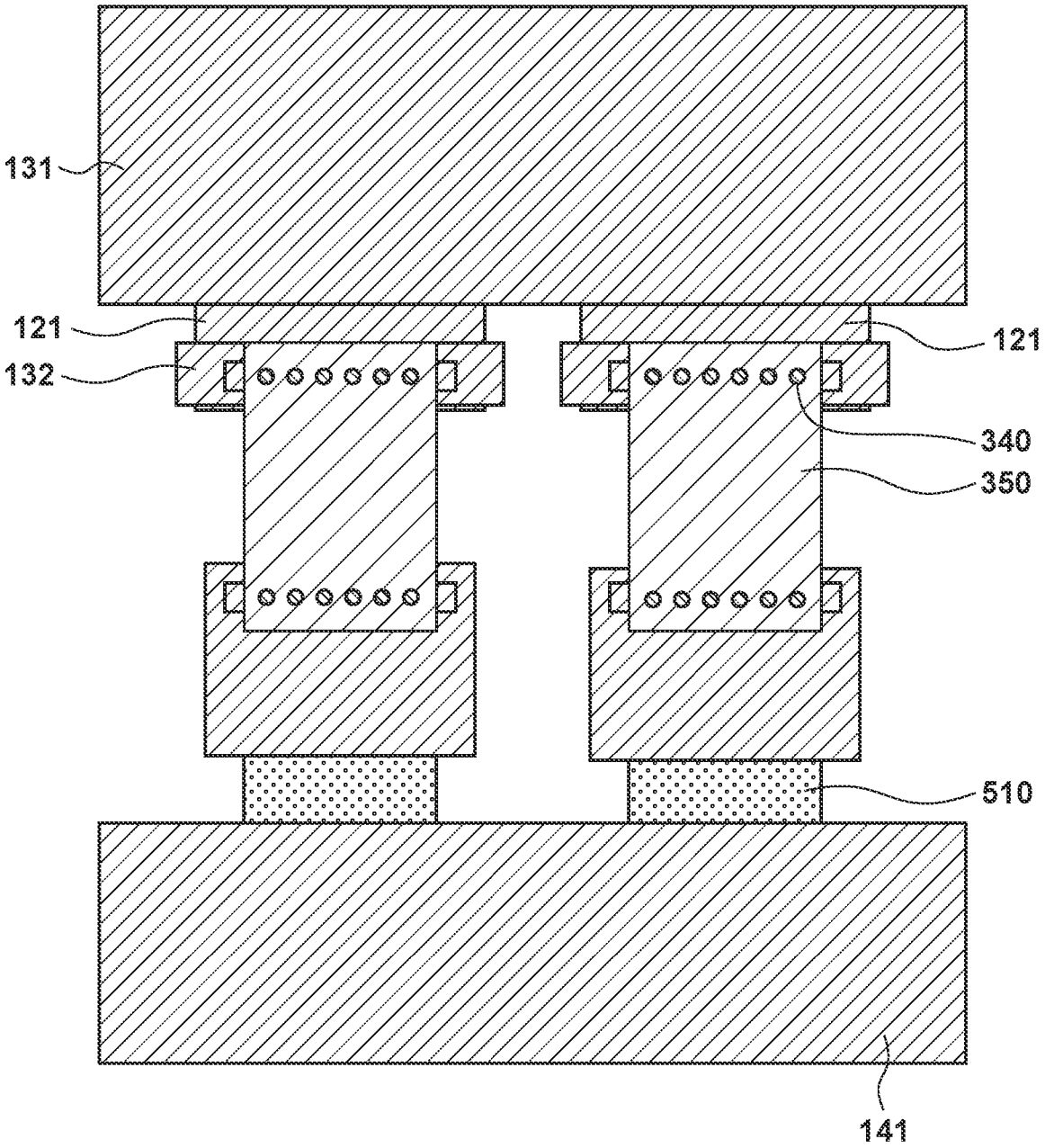
FIG. 13 is a plan view showing the state of the wirings of two heaters integrated on the element substrate shown in FIG. 12.

FIG. 13 is a plan view showing the state of the wirings of two heaters integrated on the element substrate shown in FIG. 12. Note that the same reference numerals as already described with reference to FIG. 7 denote the same constituent elements in FIG. 13, and a description thereof will be omitted. A characteristic arrangement of the first embodiment and its effect will be described here.

As shown in FIG. 13, two heaters 350 are individually connected to the wirings 132. The heaters 350 are connected to the VH common wiring 131 via the wirings 121 formed under the wirings 132. Note that the wiring 121 is also formed as an individual wiring provided in correspondence with each heater.

The detailed structure of the through-hole 320 will be described here with reference to FIG. 8C.

As shown in FIG. 8C, the through-hole 320 is formed into a columnar shape while penetrating the insulation layer 220 on the wiring layer 120 made of, for example, Al (aluminum) to a thickness of 400 μm. The diameter is 0.4 μm, and the height is 0.6 μm. The aspect ratio at this time is 0.6/0.4=1.5. A barrier metal layer 326 exists around a conductive plug (to be referred to as a plug hereinafter) 325 that fills the interior of the through-hole 320. The plug 325 is generally made of tungsten, and the barrier metal layer is made of, for example, titanium Ti or a material (for example, TiN) containing Ti.

On the other hand, the through-hole 330 shown in FIG. 8B is formed and arranged in a columnar shape while penetrating the insulation layer 230 on the wiring layer 130 formed to a thickness of, for example, 1 μm. The through-hole 330 is formed to, for example, a diameter of 0.6 μm and a height of 1.4 μm. The aspect ratio at this time is 1.4/0.6=2.333.

Note that the through-hole 330 is not limited to a through-hole formed and arranged in a columnar shape as shown in FIG. 8B.

Figure 14:
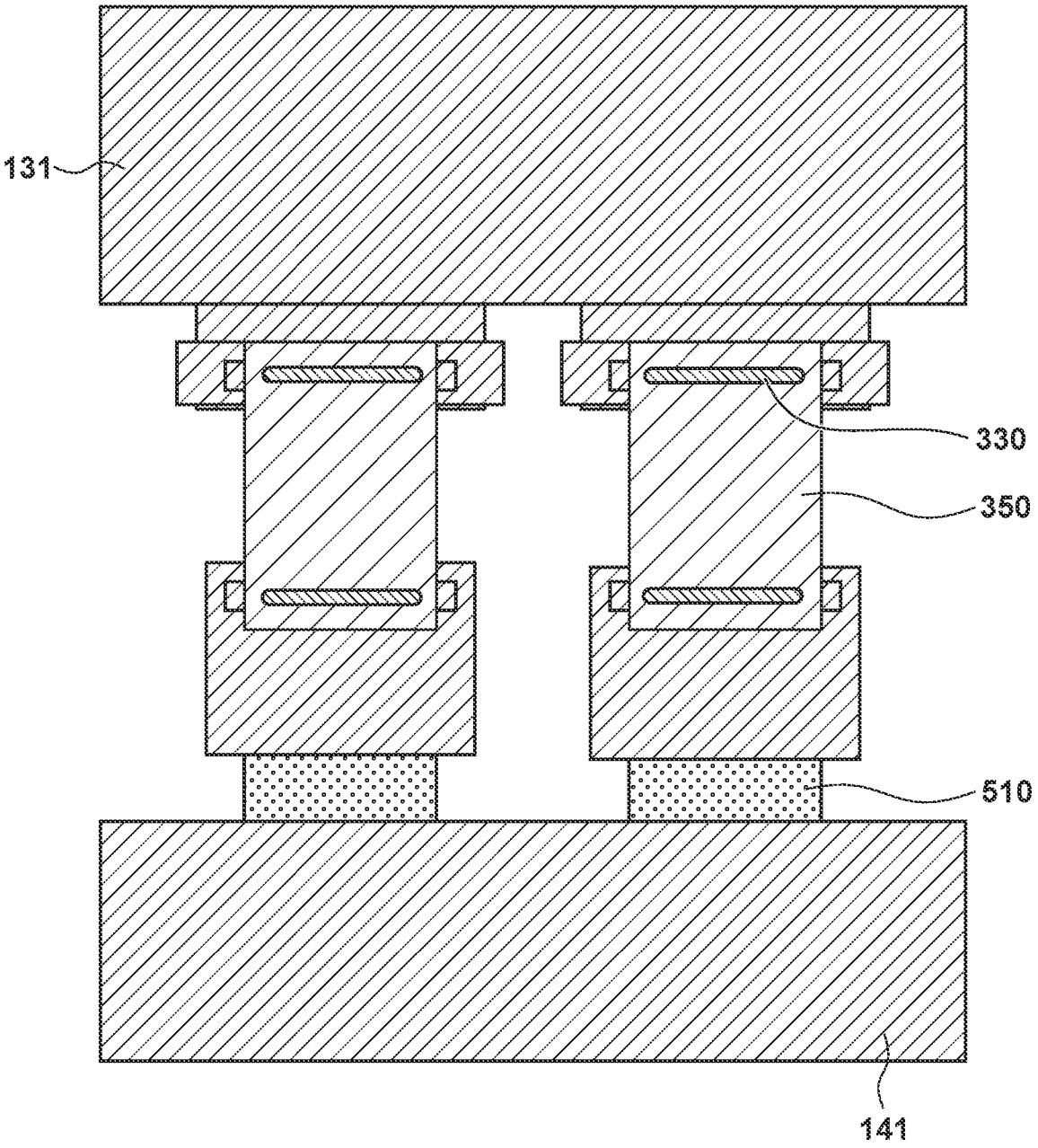
FIG. 14 is a plan view showing a through-hole 330 formed into a slit shape.

FIG. 14 is a plan view showing the through-hole 330 formed into a slit shape. For example, the slit-shaped through-hole 330 is formed into a rectangular shape having a longitudinal direction along the array direction of the plurality of through-holes 330 having a circular planar shape shown in FIG. 13.

The aspect ratio at this time can be represented by the ratio of a narrow portion having an influence on the coatability to the height. For example, if the slit width is 0.6 μm, the slit length is 6.6 μm, and the height is 1.4 μm, the aspect ratio is 1.4/0.6=2.333 (independently of the slit length).

As shown in FIG. 8B, the barrier metal layer 336 exists around the plug 335 of the through-hole 330. The plug 335 is made of tungsten, like the plug 325, and the barrier metal layer 336 is made of titanium Ti or a material (for example, TiN) containing Ti, like the through-hole 320.

The through-hole 320 and the through-hole 330 will be compared here. In the through-hole 330, the aspect ratio is high, the film thickness of the barrier metal layer 336 readily becomes small at the corner portion 337, and the coatability is relatively poor. Note that in the through-hole 340 as well, the aspect ratio is higher than the through-hole 320, and the coatability of the barrier metal layer 346 is relatively poor, like the through-hole 330. On the other hand, in the through-hole 320, the aspect ratio is low, and the coatability of the barrier metal layer 326 is high even at a corner portion 327. To obtain a high coatability of the barrier metal at the corner portion of the through-hole, the aspect ratio of the through-hole is preferably 2 or less.

According to the arrangement of the above-described embodiment, one terminal of the heater is connected to the VH common wiring via the through-hole whose barrier metal layer has a high coatability. Hence, even if the wiring between the heater and the VH common wiring breaks, and the plug made of tungsten is dissolved by ink, the progress of dissolution can be suppressed by the barrier metal layer of the high coatability.

That is, in this embodiment, the individual wiring 131, the through-hole 320, and the wiring layer 120, which are unnecessary as an electrical path, are provided on purpose between the heater and the VH common wiring, and the heater and the VH common wiring are electrically connected via these, thereby suppressing spread of electric erosion to the VH common wiring. In addition, since the insulation layer 220 in which the through-hole 320 is formed covers the wiring layer 120 whose film thickness is relatively small, the film thickness of the insulation layer 220 is smaller than the insulation layer 230 that covers the wiring layer 130 whose film thickness is relatively large. Hence, the aspect ratio of the through-hole 320 formed in the insulation layer 220 can easily be made low as compared to the through-hole 330 formed in the insulation layer 230, and a barrier metal layer having a high coatability can readily be formed in the through-hole 320.

Figure 15:
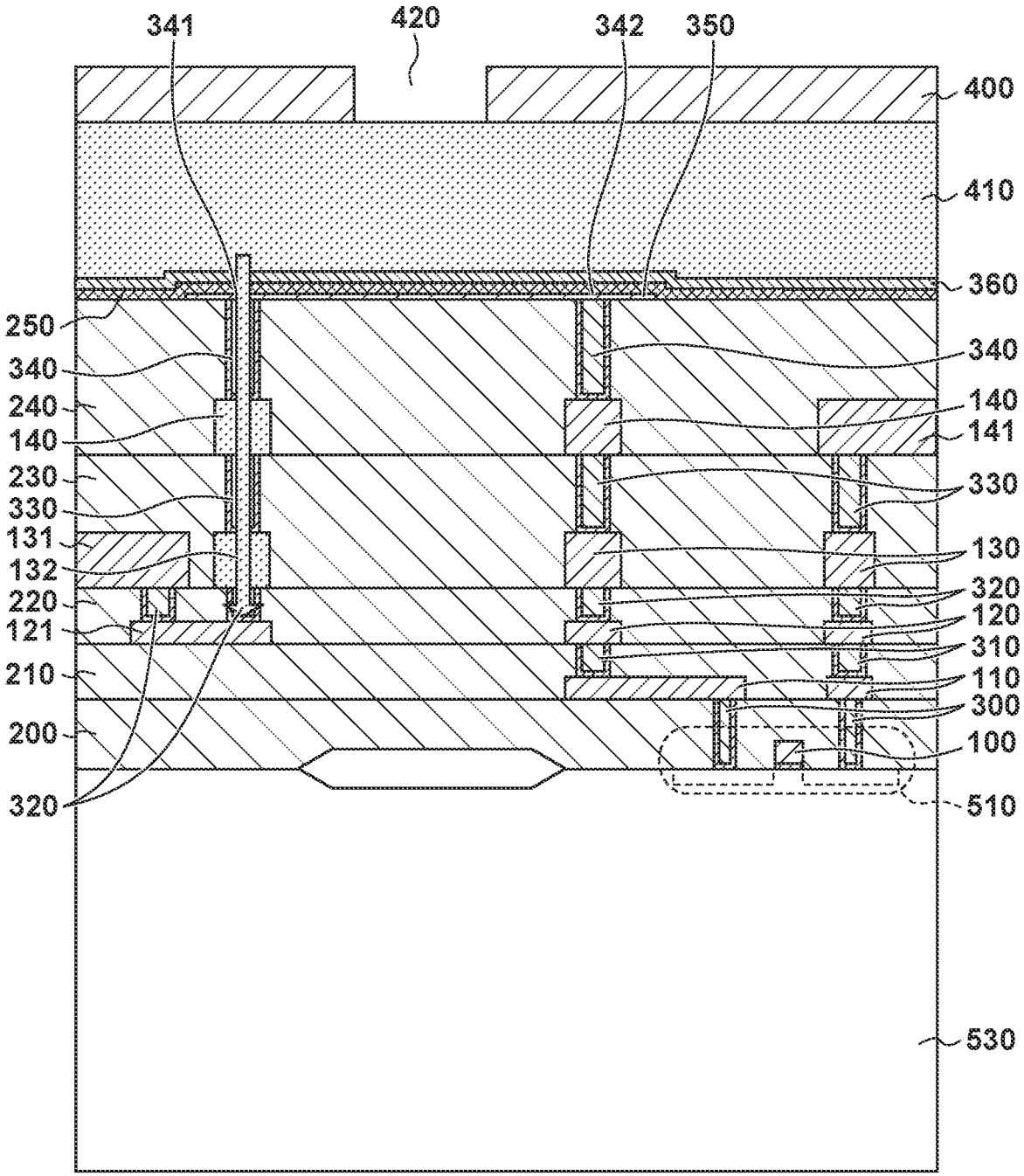
FIG. 15 is a view schematically showing a state in which a plug has dissolved due to a wire break in a wiring of the element substrate shown in FIG. 12.

FIG. 15 is a view schematically showing a state in which a plug has dissolved due to a wire break in the wiring of the element substrate shown in FIG. 12.

As shown in FIG. 15, the plugs 340 and 330 dissolve, the dissolution penetrates the wirings 140 and 132, and the barrier metal layer 326 of the plug 320 stops the progress of dissolution. Hence, the dissolution does not reach the VH common wiring 131, and the dissolution does not progress to the wiring portion of the adjacent heater.

Second Embodiment

Figure 16:
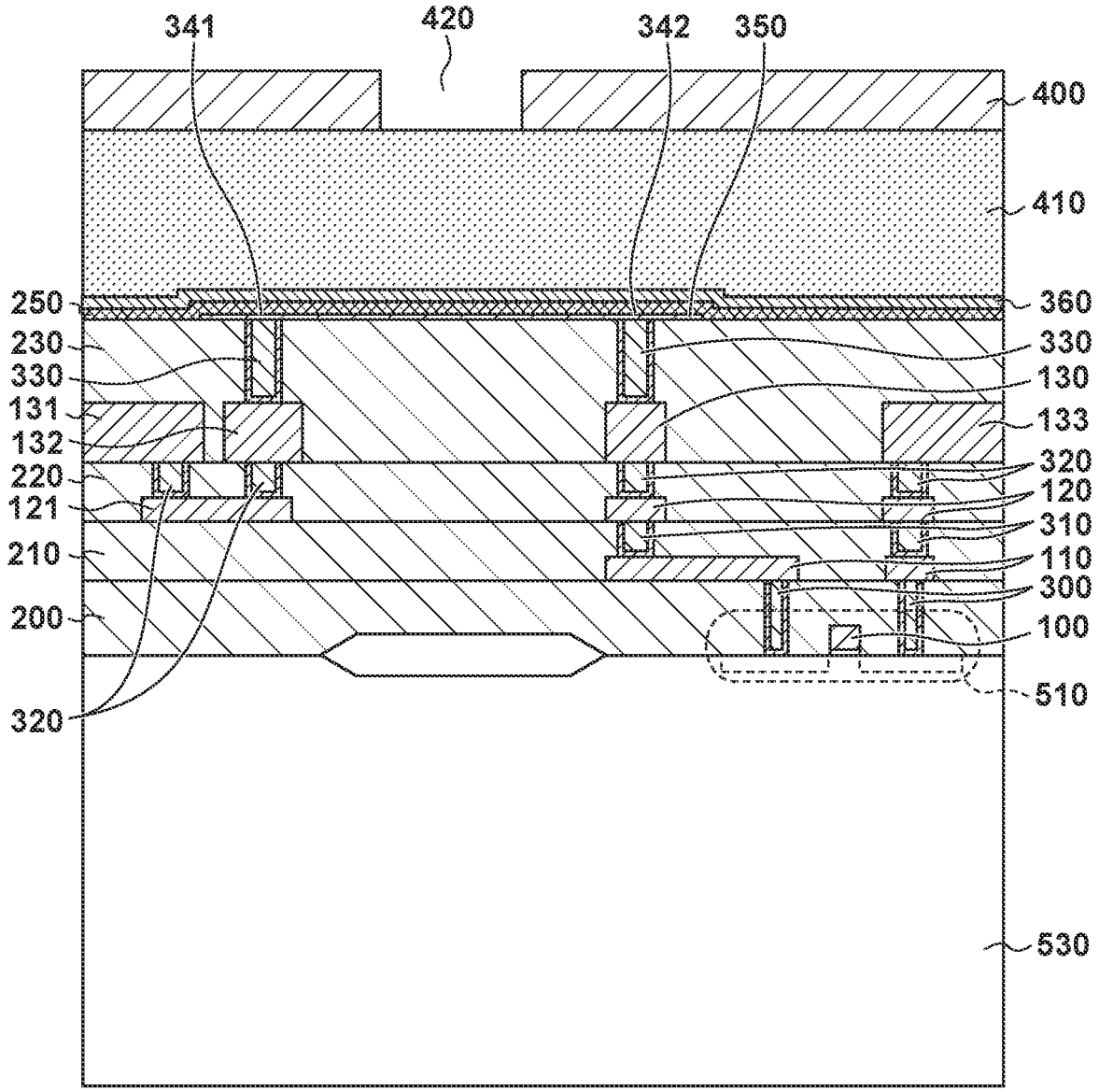
FIG. 16 is a sectional view showing the multilayer structure of an element substrate according to the second embodiment.

FIG. 16 is a sectional view showing the multilayer structure of an element substrate according to the second embodiment. Note that the same reference numerals as already described with reference to FIGS. 6, 9, and 12 denote the same constituent elements in FIG. 16, and a description thereof will be omitted. A characteristic arrangement of the second embodiment will be described here.

In this example, a connecting portion 341 of a heater 350 is connected to a VH common wiring 131 formed in a wiring layer 130 via a through-hole 330, a wiring 132 formed in the wiring layer 130, a through-hole 320, a wiring 121 formed in a wiring layer 120, and the through-hole 320.

As described above, the VH common wiring 131 is connected to a part of a pad 450 of the element substrate, and a voltage is supplied from the outside. The other connecting portion 342 of the heater is connected to one terminal of a switching element 510 via the through-hole 330, the wiring layer 130, the through-hole 320, the wiring layer 120, a through-hole 310, a wiring layer 110, and a through-hole 300. The other terminal of the switching element 510 is connected to a GND common wiring 133 formed in the wiring layer 130 via the through-hole 300, the wiring layer 110, the through-hole 310, the wiring layer 120, and the through-hole 320. Here, the VH common wiring 131 and the GND common wiring 133 are formed in the same wiring layer 130.

According to the above-described embodiment, the VH common wiring and the GND common wiring are formed in the same wiring layer, unlike the first embodiment. In this arrangement as well, as in the first embodiment, even if the wiring between the heater and the switching element breaks, and the plug made of tungsten is dissolved by ink, the progress of dissolution can be suppressed by the barrier metal layer of the high coatability.

Third Embodiment

Figure 17:
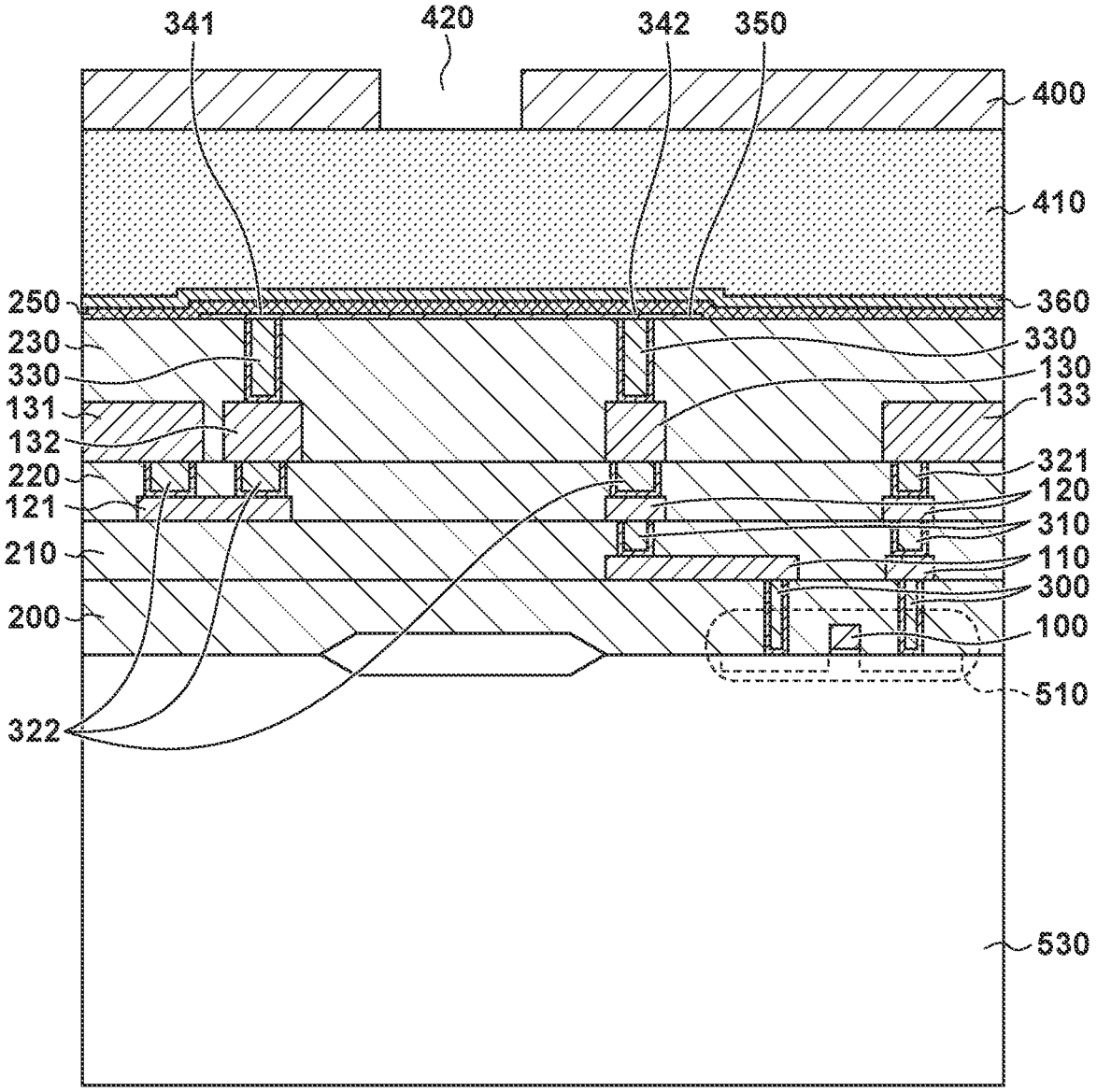
FIG. 17 is a sectional view showing the multilayer structure of an element substrate according to the third embodiment.

FIG. 17 is a sectional view showing the multilayer structure of an element substrate according to the third embodiment. Note that the same reference numerals as already described with reference to FIGS. 6, 9, 12, and 16 denote the same constituent elements in FIG. 17, and a description thereof will be omitted. A characteristic arrangement of the third embodiment will be described here.

In this example, through-holes 321 and 322 having different diameters and penetrating an insulation layer 220 are formed. A connecting portion 341 of a heater 350 is connected to a through-hole 330, a wiring 132 formed in a wiring layer 130, the through-hole 322, and a wiring 121 formed in a wiring layer 120. The connecting portion 341 is further connected from the wiring 121 to a VH common wiring 131 formed in the wiring layer 130 via the through-hole 322. The VH common wiring 131 is connected to a part of a pad 450 of the element substrate, and a voltage is supplied from the outside.

The other connecting portion 342 of the heater 350 is connected to one terminal of a switching element 510 via the through-hole 330, the wiring layer 130, the through-hole 322, the wiring layer 120, a through-hole 310, a wiring layer 110, and a through-hole 300. The other terminal of the switching element 510 is connected to a GND common wiring 133 formed in the wiring layer 130 via the through-hole 300, the wiring layer 110, the through-hole 310, the wiring layer 120, and the through-hole 321.

As is apparent from FIG. 17, the through-holes 321 and 322 are formed to penetrate the same insulation layer 220. However, the aspect ratio of the through-hole 322 that connects the individual wiring 132 is lower than that of the through-hole 321. For example, the through-hole 321 is formed into a columnar shape while penetrating the insulation layer 220 on the wiring layer 120. The diameter is 0.4 μm, and the height is 0.6 μm. The aspect ratio at this time is 0.6/0.4=1.5. On the other hand, the through-hole 322 is formed into a columnar shape while penetrating the insulation layer 220 on the wiring layer 120. The diameter is 1.0 μm, and the height is 0.6 μm. The aspect ratio at this time is 0.6/1.0=0.6.

Hence, according to the above-described embodiment, since the aspect ratio of the through-hole becomes lower as compared to the first embodiment, the coatability of the barrier metal layer can be made higher even at the corner portion of the through-hole.

Note that in the above-described embodiments, the printhead that discharges ink and the printing apparatus have been described as an example. However, the present invention is not limited to this. The present invention can be applied to an apparatus such as a printer, a copying machine, a facsimile including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiments can also be considered as a liquid discharge head in general. The substance discharged from the head is not limited to ink, and can be considered as a liquid in general.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-082198, filed Apr. 23, 2019, which is hereby incorporated by reference herein in its entirety.

What is claimed is:

1. A multilayer structured element substrate comprising:

a heater layer in which a plurality of heaters are formed;

a first wiring layer in which a first common wiring configured to supply, from an outside, a voltage to the plurality of heaters is formed;

an individual wiring formed in the first wiring layer, separated from the first common wiring, and individually connected to each of the plurality of heaters;

a first conductive plug provided between the heater layer and the first wiring layer and filling an interior of a first through-hole penetrating a first insulation layer that covers the first wiring layer;

a second wiring layer formed in a layer provided away from the heater layer with respect to the first wiring layer; and a second conductive plug and a third conductive plug, each provided between the first wiring layer and the second wiring layer and respectively filling an interior of a second through-hole and a third through-hole, the second through-hole and the third through-hole each penetrating a second insulation layer that covers the second wiring layer, the second conductive plug connecting the individual wiring and a wiring of the second wiring layer, and the third conductive plug connecting the first common wiring and the wiring of the second wiring layer, wherein each of the plurality of heaters is connected to the individual wiring via the first conductive plug, and the individual wiring is connected to the first common wiring via the second conductive plug and the wiring of the second wiring layer, and an aspect ratio of each of the second through-hole and the third through-hole is lower than an aspect ratio of the first through-hole.

2. The element substrate according to claim 1, further comprising:

a switching layer in which a plurality of switching elements connected to the plurality of heaters are formed in a layer provided away from the heater layer with respect to the second wiring layer; and a second common wiring configured to connect the plurality of switching elements to GND.

3. The element substrate according to claim 2, wherein the second common wiring is formed in the first wiring layer.

4. The element substrate according to claim 2, wherein the second common wiring is formed in a third wiring layer provided between the heater layer and the first wiring layer.

5. The element substrate according to claim 1, wherein the aspect ratio of the second through-hole is lower than an aspect ratio of the third through-hole.

6. The element substrate according to claim 1, wherein the aspect ratio is a ratio of a diameter of a through-hole penetrating an insulation layer to a height of the through-hole.

7. The element substrate according to claim 1, wherein a first barrier metal layer is formed on a first wiring layer-side surface side and around a side surface side of the first conductive plug in the first through-hole, and a second barrier metal layer is formed on a second wiring layer-side surface side and around a side surface side of the second conductive plug in the second through-hole.

8. The element substrate according to claim 7, wherein the first conductive plug and the second conductive plug are made of tungsten, and the first barrier metal layer and the second barrier metal layer are essentially made of one of titanium Ti and a material containing Ti.

9. The element substrate according to claim 1, wherein a height of the first through-hole is larger than a height of the second through-hole.

10. The element substrate according to claim 1, wherein a film thickness of the first wiring layer is larger than a film thickness of the second wiring layer.

11. A liquid discharge head using a multilayer structured element substrate comprising:

a plurality of orifices configured to discharge a liquid, wherein the element substrate comprises:

a heater layer in which a plurality of heaters are formed;

a first wiring layer in which a first common wiring configured to supply, from an outside, a voltage to the plurality of heaters is formed;

an individual wiring formed in the first wiring layer, separated from the first common wiring and individually connected to each of the plurality of heaters;

a first conductive plug provided between the heater layer and the first wiring layer and filling an interior of a first through-hole penetrating a first insulation layer that covers the first wiring layer;

a second wiring layer formed in a layer provided away from the heater layer with respect to the first wiring layer; and a second conductive plug and a third conductive plug, each provided between the first wiring layer and the second wiring layer and respectively filling an interior of a second through-hole and a third through-hole, the second through-hole and the third through-hole each penetrating a second insulation layer that covers the second wiring layer, the second conductive plug connecting the individual wiring and a wiring of the second wiring layer, and the third conductive plug connecting the first common wiring and the wiring of the second wiring layer, wherein each of the plurality of heaters is connected to the individual wiring via the first conductive plug, and the individual wiring is connected to the first common wiring via the second conductive plug and the wiring of the second wiring layer, and an aspect ratio of each of the second through-hole and the third through-hole is lower than an aspect ratio of the first through-hole.

12. The liquid discharge head according to claim 11, wherein the liquid is ink, and the liquid discharge head is an inkjet printhead.

13. A printing apparatus for performing printing on a print medium using a liquid discharge head configured to discharge a liquid as a printhead configured to discharge ink as the liquid, wherein the liquid discharge head comprises:

a plurality of orifices configured to discharge the liquid; and a multilayer structured element substrate, wherein the element substrate comprises:

a heater layer in which a plurality of heaters are formed;

a first wiring layer in which a first common wiring configured to supply, from an outside, a voltage to the plurality of heaters is formed;

an individual wiring formed in the first wiring layer, separated from the first common wiring, and individually connected to each of the plurality of heaters;

a first conductive plug provided between the heater layer and the first wiring layer and filling an interior of a first through-hole penetrating a first insulation layer that covers the first wiring layer;

a second wiring layer formed in a layer provided away from the heater layer with respect to the first wiring layer; and a second conductive plug and a third conductive plug, each provided between the first wiring layer and the second wiring layer and respectively filling an interior of a second through-hole and a third through-hole, the second through-hole and the third through-hole each penetrating a second insulation layer that covers the second wiring layer, the second conductive plug connecting the individual wiring and a wiring of the second wiring layer, and the third conductive plug connecting the first common wiring and the wiring of the second wiring layer, wherein each of the plurality of heaters is connected to the individual wiring via the first conductive plug, and the individual wiring is connected to the first common wiring via the second conductive plug and the wiring of the second wiring layer, and an aspect ratio of each of the second through-hole and the third through-hole is lower than an aspect ratio of the first through-hole.

* * * * *